US010239091B2

(12) United States Patent
Shinkoda

(10) Patent No.: US 10,239,091 B2
(45) Date of Patent: Mar. 26, 2019

(54) METHOD FOR FORMING MULTILAYER COATING FILM

(71) Applicant: KANSAI PAINT CO., LTD., Hyogo (JP)

(72) Inventor: Shoichi Shinkoda, Kanagawa (JP)

(73) Assignee: KANSAI PAINT CO., LTD., Hyogo (JP)

( * ) Notice: Subject to any disclaimer, the term of this patent is extended or adjusted under 35 U.S.C. 154(b) by 0 days.

(21) Appl. No.: 15/516,999

(22) PCT Filed: Aug. 25, 2015

(86) PCT No.: PCT/JP2015/073843
§ 371 (c)(1),
(2) Date: Apr. 5, 2017

(87) PCT Pub. No.: WO2016/063614
PCT Pub. Date: Apr. 28, 2016

(65) Prior Publication Data

US 2017/0297052 A1 Oct. 19, 2017

(30) Foreign Application Priority Data

Oct. 23, 2014 (JP) ..... 2014-216089

(51) Int. Cl.
*B05D 5/06* (2006.01)
*B05D 7/00* (2006.01)
*B05D 1/00* (2006.01)

(52) U.S. Cl.
CPC ..... *B05D 5/06* (2013.01); *B05D 1/007* (2013.01); *B05D 7/57* (2013.01)

(58) Field of Classification Search
None
See application file for complete search history.

(56) References Cited

U.S. PATENT DOCUMENTS

| | | | | |
|---|---|---|---|---|
| 6,165,621 | A | 12/2000 | Kasari et al. | |
| 2005/0031873 | A1* | 2/2005 | Berschel | B05D 7/572 428/411.1 |
| 2007/0077437 | A1* | 4/2007 | Kakii | B05D 5/068 428/424.4 |
| 2013/0078383 | A1* | 3/2013 | Yokoyama | B05D 5/005 427/379 |

FOREIGN PATENT DOCUMENTS

| | | |
|---|---|---|
| JP | 2001-314807 | 11/2001 |
| JP | 2005-205262 | 8/2005 |
| JP | 2005-255948 | 9/2005 |
| JP | 2005-305424 | 11/2005 |
| JP | 2008-62198 | 3/2008 |
| JP | 2008-126095 | 6/2008 |
| WO | 97/47396 | 12/1997 |

OTHER PUBLICATIONS

International Search Report dated Nov. 24, 2015 in International (PCT) Application No. PCT/JP2015/073843.

* cited by examiner

*Primary Examiner* — Michael P. Rodriguez
(74) *Attorney, Agent, or Firm* — Wenderoth, Lind & Ponack, L.L.P.

(57) ABSTRACT

The problem to be solved by the present invention is to provide a method for forming a multilayer coating film capable of forming a red-based multilayer coating film having high chroma and an excellent sense of depth and weatherability. The present invention provides a method for forming a multilayer coating film comprising the steps of (1) applying a first colored coating composition comprising an organic red pigment to form a first colored coating film having a hue such that the hue angle h in the L*C*h color space diagram is within the range of 23±3°, (2) applying a second colored coating composition comprising an organic red pigment to the first colored coating film to form a second colored coating film having a hue such that the hue angle h in L*C*h color space diagram is within the range of 35±5°, and (3) applying a clear coating composition to the second colored coating film to form a clear coating film; wherein the color difference ΔE between the first colored coating film and the multilayer coating film obtained by Steps (1) to (3) is within the range of 20 to 30.

8 Claims, No Drawings

METHOD FOR FORMING MULTILAYER COATING FILM

TECHNICAL FIELD

Cross Reference of Related Application

This application claims priority to JP2014-216089A, filed Oct. 23, 2014, the disclosure of which is incorporated herein by reference in its entirety. The present invention relates to a method for forming a red-based multilayer coating film having high chroma and excellent weatherability.

Background Art

As for the exterior color of industrial products, such as automobiles, a metallic paint color whose appearance varies depending on the observation angle is mainly used. Further, a paint color having high chroma from highlights to shades and an excellent sense of depth is one of the highly-demanded paint colors because it provides a luxurious appearance and excellent attractiveness.

A metallic paint color with high chroma, in particular, a red-based metallic paint color with high chroma has difficulty in satisfying all of the properties, such as masking property, weather resistance, and application workability.

Patent Literature 1, for example, discloses a method for forming a metallic coating film comprising sequentially applying a metallic base coating composition, a second base coating composition having transmittance, and a clear coating composition. However, since paint color greatly changes with a small change in the thickness of the second base coating film having transmittance, this method has problems in that the coating line is difficult to control, and the weather resistance of the coating film is insufficient.

Patent Literature 2 discloses a method for forming a multilayer coating film with a highly beautiful appearance comprising the steps of: applying a first coating composition comprising a color component and/or a luster material to the surface of an article to be coated to form a first coating film, applying a second coating composition containing a color component in an amount of 0.01 to 1 wt % based on the resin solids content in the coating composition to the first coating film to form a second coating film without heat-curing the first coating film, and applying a clear coating composition to the second coating film to form a clear coating film without heat-curing the second coating film. However, this method has problems in that the chroma of the coating film is insufficient, paint color unevenness is generated by a change in film thickness, and the weather resistance of the coating film is insufficient.

Patent Literature 3 discloses a method for forming a multilayer coating film, comprising applying a clear coating composition (B) to a base coat, which is obtained by applying a base coating composition (A) containing an effect pigment to a substrate, then curing the coating film by heating to obtain a clear coat, further applying a color clear coating composition (C) comprising a color pigment and/or a dye to the clear coat to obtain a color clear coat, and applying a top clear coating composition (D) to the color clear coat. However, this method is a 4C2B process in which a 2C1B process is performed twice, which requires a number of steps, resulting in poor productivity.

CITATION LIST

Patent Literature

PTL 1: WO97/47396
PTL 2: JP2001-314807A
PTL 3: JP2005-305424A

SUMMARY OF INVENTION

Technical Problem

An object of the present invention is to provide a method for forming a multilayer coating film, the method being capable of solving the above defects and forming a red-based multilayer coating film having high chroma, excellent sense of depth, and excellent weatherability.

Solution to Problem

Specifically, the present invention relates to the following:

A method for forming a multilayer coating film, comprising the steps of:

(1) applying a first colored coating composition comprising an organic red pigment to form a first colored coating film having a hue such that the hue angle h in an L*C*h color space diagram is within the range of 23±3°, (2) applying a second colored coating composition comprising an organic red pigment to the first colored coating film to form a second colored coating film having a hue such that the hue angle h in an L*C*h color space diagram is within the range of 35±5°, and (3) applying a clear coating composition to the second colored coating film to form a clear coating film;

wherein a color difference ΔE between the first colored coating film and the multilayer coating film obtained by Steps (1) to (3) is within the range of 20 to 30.

Advantageous Effects of Invention

According to the present invention, a red-based multilayer coating film having high chroma and an excellent sense of depth can be obtained. The multilayer coating film also ensures excellent weatherability in which almost no degradation, such as fading or discoloration, is observed even after the multilayer coating film is stored outside for a long period of time.

DESCRIPTION OF EMBODIMENTS

Step (1)

According to the method of the present invention, in Step (1), a first colored coating composition is first applied to form a first colored coating film. The first colored coating composition is a composition providing a masking property and determining the hue, in particular, the hue in the shade of the multilayer coating film to be formed. The first colored coating composition comprises an organic red pigment as an essential component.

The hue of the first colored coating film obtained by applying the first colored coating composition is such that the hue angle h in the L*C*h color space diagram is within the range of 23±3°.

The "L*C*h color space" is the L*a*b* color space shown in polar coordinates, which was standardized in 1976 by Commission Internationale de l'Eclairage, and also adopted in JIS Z 8729. L* represents lightness, C* represents chroma, which is the distance from the center axis, and h represents a hue angle moved from the axis of the a* red direction (=0°) in the counterclockwise direction in the L*a*b* color space diagram.

The hue angle h and chroma C* of the first colored coating film are obtained as follows. The first colored coating composition is applied to a dry thickness of 15 μm to a coating plate on which a dark gray (N−2) coating film is previously formed, followed by dry-heating at 140° C. for 30 minutes, thereby forming a coating plate. Using a multiangle spectrophotometer ("MA-68," trade name, produced by X-Lite Incorporated), the coating plate is subjected to colorimetry to measure its hue angle h and chroma C* in the L*C*h color space. The light-receiving angle is 75°, which corresponds to the shade.

As the organic red pigment used in the first colored coating composition, pigments that are conventionally known to be used for coating compositions or inks can be used singly or in a combination of two or more according to the desired color.

Examples of the organic red pigment include azo pigments, quinacridone pigments, diketo pyrrolo-pyrrole pigments, perylene pigments, perinone pigments, and the like.

From the viewpoint of the chroma and weatherability of the multilayer coating film to be obtained, a quinacridone pigment is preferably contained as the organic red pigment of the first colored coating composition.

From the viewpoint of the chroma of the multilayer coating film to be obtained, the content of the organic red pigment in the first colored coating composition is preferably in the range of 1 to 20 mass % and more preferably 5 to 15 mass % based on the total resin solids content in the first colored coating composition.

The first colored coating composition can optionally contain a color pigment other than organic red pigments. As the color pigment other than organic red pigments, pigments that are conventionally known to be used for inks or coating compositions can be used singly or in a combination of two or more.

Examples of the color pigment include metal oxide pigments, such as titanium oxide and iron oxide; metal oxide complex pigments, such as titan yellow; carbon black; organic pigments, such as benzimidazolone pigments, isoindoline pigments, isoindolinone pigments, metal chelate azo pigments, phthalocyanine pigments, indanthrone pigments, dioxazine pigments, indigo pigments; and the like.

The amount of the color pigment other than organic red pigments is not particularly limited. To obtain a red-based multilayer coating film with high chroma, the amount of the color pigment other than organic red pigments is generally within the range of 10 mass % or less, preferably 5 mass % or less, particularly preferably 3 mass % or less, and even more preferably 2 mass % or less based on the total resin solids content in the first colored coating composition.

Of the above, iron oxide is preferably contained to improve the weatherability of the multilayer coating film. To attain both excellent weatherability and chroma, the content of iron oxide is within the range of 5 mass % or less, preferably 3 mass % or less, particularly preferably 1.5 mass % or less, and even more preferably 0.1 to 1.0 mass % based on the total resin solids content in the first colored coating composition.

In the method of the present invention, the color pigment incorporated in the first colored coating composition, and the second colored coating composition and clear coating composition, which are described later, can be inorganic and/or organic surface-treated to improve dispersibility, weatherability, etc.

The first colored coating composition can further include an effect pigment (in particular, a metal flake pigment) to improve the masking property without reducing chroma. Effect pigments that are known to be used for coating compositions can be used singly or in a combination of two or more.

Examples of the effect pigment include scale-like metallic pigments, such as aluminum, copper, nickel alloy, and stainless steel; scale-like metallic pigments whose surfaces are covered with metal oxide; scale-like metallic pigments onto whose surfaces color pigment is chemically adsorbed; scale-like aluminum pigments onto whose surfaces an aluminum oxide layer is formed by inducing an oxidation reduction reaction; aluminum-dissolved iron oxide flake pigments; glass flake pigments, glass flake pigments whose surfaces are covered with metal oxide, and glass flake pigments onto whose surfaces color pigment is chemically absorbed; interference mica pigments whose surfaces are covered with titanium dioxide, reduced mica pigments obtained by reducing interference mica pigment, colored mica pigments onto whose surfaces color pigment is chemically absorbed or whose surfaces are covered with iron oxide; graphite pigments whose surfaces are covered with titanium dioxide; silica flake or alumina flake pigments whose surfaces are covered with titanium dioxide; iron oxide flake pigments; holographic pigments; synthetic mica pigments; helical cholesteric liquid crystal polymer pigments; bismuth oxychloride pigments; and the like. These pigments can be used singly or in a combination of two or more.

Of these, scale-like metallic pigments, scale-like metallic pigments whose surfaces are cover with metal oxide, scale-like metallic pigments onto whose surfaces color pigment is chemically adsorbed, and colored mica pigments whose surfaces are covered with metal oxide are preferable, and aluminum flake pigments, which are scale-like metallic pigments, are particularly preferable. However, examples are not limited thereto, and effect pigments can be suitably used in accordance with the masking property, chroma, and desired luster of the coating film.

The amount of the effect pigment is generally within the range of 1 to 30 mass %, preferably 2 to 20 mass %, and more preferably 3 to 15 mass % based on the total resin solids content in the first colored coating composition.

Of the effect pigments, scale-like metallic pigments whose surfaces are covered with metal oxide, particularly aluminum pigments covered with iron oxide, are preferably used to effectively improve the masking property and weatherability of the multilayer coating film to be obtained.

The amount of the scale-like metallic pigment whose surface is covered with metal oxide is generally within the range of 1 to 20 mass %, preferably 1 to 15 mass %, and more preferably 2 to 10 mass % based on the total resin solids content in the first colored coating composition.

The following aluminum pigment covered with iron oxide is preferably used. The hue of a coating film that only contains, as a coloring agent, an aluminum pigment covered with iron oxide, is such that the hue angle h in the L*C*h color space diagram is within the range of 0 to 50°, and particularly 20 to 40°.

The hue angle h can be measured using a multiangle spectrophotometer "MA-68" (trade name) produced by X-Lite Incorporated, a color difference meter "CR Series"

(trade name) produced by Konica Minolta Co., Ltd., an SN color computer (trade name) produced by Suga Test Instruments Co., Ltd., or the like.

The aluminum pigment covered with iron oxide is not particularly limited; usable examples include a coloring aluminum flake pigment with excellent weatherability, which is obtained by covering an aluminum substrate with iron oxide by a chemical vapor deposition method whose production process and characteristics are described in JPH06-145555A.

The total content of the pigment used in the first colored coating composition is preferably within the range of 1 to 50 mass %, particularly preferably 3 to 40 mass %, and even more preferably 5 to 30 mass % based on the total resin solids content in the first colored coating composition from the viewpoint of the masking property, and the chroma and weatherability of the multilayer coating film to be obtained.

The first colored coating composition may generally contain a resin component as a vehicle. As a resin component, a heat-curable resin composition is preferably used. Specific examples thereof include heat-curable resin compositions of a base resin having a crosslinkable functional group (e.g., a hydroxyl group), such as acrylic resin, polyester resin, alkyd resin, and urethane resin, with a crosslinking agent, such as melamine resin, urea resin, and a polyisocyanate compound (including a blocked polyisocyanate compound). Such heat-curable compositions are dissolved or dispersed in a solvent such as an organic solvent and/or water, before use. The proportion of the base resin and the crosslinking agent in the resin composition is not particularly limited. The crosslinking agent is generally within the range of 10 to 100 mass %, preferably 20 to 80 mass %, and more preferably 30 to 60 mass % based on the total base resin solids content.

Moreover, the first colored coating composition may optionally and suitably contain a solvent, such as water or an organic solvent; various additives for coating compositions, such as a rheology control agent, a pigment dispersant, an antisettling agent, a curing catalyst, an antifoaming agent, an antioxidizing agent, and an ultraviolet absorber; an extender pigment; and the like.

The first colored coating composition may be prepared by mixing and dispersing the components described above.

The color pigment incorporated in the first colored coating composition, and the second colored coating composition and clear coating composition, which are described later, may be incorporated in the coating composition as a powder. The color pigment may also be mixed with and dispersed in a part of a resin component in the coating composition to prepare a pigment dispersion beforehand, and the pigment dispersion may be mixed with the remaining resin component and/or other components to prepare a coating composition. In the preparation of the pigment dispersion, conventional additives used for coating compositions, such as an antifoaming agent, a dispersant, a surface control agent, and the like may optionally be added.

The first colored coating composition is applied by a method, such as electrostatic spraying, air spraying, or airless spraying. The first colored coating composition is generally applied such that the resulting coating film, when cured, has a thickness of 1 to 40 μm, and preferably 5 to 30 μm from the viewpoint of the smoothness, etc. of the coating film.

The first colored coating composition is preferably prepared in a manner such that the solids content is generally 15 to 50 mass %, and preferably 20 to 40 mass %, and the viscosity as measured using a B-type viscometer (Rotor No. 3 or 4) at 20° C. is 2000 to 6000 mPa·s.

The first colored coating film per se, which is obtained by applying the first colored coating composition, can generally be cured at about 50 to 180° C. in the case of the thermosetting type, and can generally be cured at about an ordinary temperature to about 80° C. in the case of the normal temperature drying type or a forced drying type.

In the method according to the present invention, the second colored coating composition can be applied after the first colored coating film, which is obtained by applying the first colored coating composition, is cured, or the second colored coating composition can be applied on the uncured first colored coating film, without curing the first colored coating film.

Step (2)

According to the method of the present invention, the second colored coating composition is applied to the first colored coating film formed in Step (1) to form a second colored coating film. The second colored coating composition is a composition increasing the chroma of the multilayer coating film to be formed to improve the sense of depth. The second colored coating composition contains an organic red pigment as an essential component.

The hue of the second colored coating film obtained by applying the second colored coating composition is such that the hue angle h in the L*C*h color space diagram is within the range of 35±5°.

The hue angle h and chroma C* of the second colored coating film are obtained as follows. The second colored coating composition is applied to a dry thickness of 15 μm to a white coating plate having a lightness L* of 85 or more, which is used as a base coat, followed by dry-heating at 140° C. for 30 minutes, thereby forming a coating plate. Using a multiangle spectrophotometer ("MA-68," trade name, produced by X-Lite Incorporated), the coating plate is subjected to colorimetry to measure its hue angle h and chroma C* in the L*C*h color space. The light-receiving angle is 45°, which corresponds to the face.

The organic red pigment used in the second colored coating composition, pigments that are conventionally known to be used for coating compositions or inks can be used singly or in a combination of two or more according to the desired color.

Examples of the organic red pigment include azo pigments, quinacridone pigments, diketo pyrrolo-pyrrole pigments, perylene pigments, perinone pigments, and the like.

From the viewpoint of the weatherability of the multilayer coating film to be obtained, a perylene pigment is preferably contained as the organic red pigment of the second colored coating composition.

To improve the weatherability of the multilayer coating film to be obtained, it is preferable to mainly use a perylene pigment as the organic red pigment of the second colored coating composition.

Further, to improve the weatherability of the multilayer coating film to be obtained, it is preferable to reduce the amount of a quinacridone pigment, which is used as the organic red pigment of the second colored coating composition, as much as possible. It is more preferable to use substantially no quinacridone pigment (quinacridone pigment is preferably not used).

From the viewpoint of the chroma and weatherability of the multilayer coating film to be obtained, the content of the organic red pigment in the second colored coating composition is preferably in the range of 0.1 to 15 mass %, more preferably 0.5 to 10 mass %, and even more preferably 1 to 5 mass % based on the total resin solids content in the second colored coating composition.

The second colored coating composition can optionally contain a color pigment other than organic red pigments. As the color pigment other than organic red pigments, pigments that are conventionally known to be used for inks or coating compositions can be used singly or in a combination of two or more.

Examples of the color pigment include metal oxide pigments, such as titanium oxide and iron oxide; metal oxide complex pigments, such as titan yellow; carbon black; organic pigments, such as benzimidazolone pigments, isoindoline pigments, isoindolinone pigments, metal chelate azo pigments, phthalocyanine pigments, indanthrone pigments, dioxazine pigments, and indigo pigments; and the like.

The amount of the color pigment other than organic red pigments is not particularly limited. To obtain a red-based multilayer coating film with high chroma, the amount of the color pigment other than organic red pigments is generally within the range of 10 mass % or less, preferably 5 mass % or less, and particularly preferably 3 mass % or less, based on the total resin solids content in the second colored coating composition.

Of the above, iron oxide is preferably contained to improve the weatherability of the multilayer coating film. To attain both excellent weatherability and chroma of the multilayer coating film, the content of iron oxide is within the range of 7.5 mass % or less, preferably 5 mass % or less, particularly preferably 2.5 mass % or less, and even more preferably 0.1 to 1 mass % based on the total resin solids content in the second colored coating composition.

Effect pigments listed in the section of the first colored coating composition can be optionally used for the second colored coating composition.

The total content of the pigment used in the second colored coating composition is preferably within the range of 0.1 to 20 mass %, and particularly preferably 0.5 to 10 mass % based on the total resin solids content in the second colored coating composition from the viewpoint of the chroma and sense of depth of the multilayer coating film to be obtained.

The second colored coating composition may generally contain a resin component as a vehicle. As a resin component, a heat-curable resin composition is preferably used. Specific examples thereof include heat-curable resin compositions of a base resin having a crosslinkable functional group (e.g., a hydroxyl group), such as acrylic resin, polyester resin, alkyd resin, and urethane resin, with a crosslinking agent, such as melamine resin, urea resin, and a polyisocyanate compound (including a blocked polyisocyanate compound). Such heat-curable compositions are dissolved or dispersed in a solvent such as an organic solvent and/or water, before use. The proportion of the base resin and the crosslinking agent in the resin composition is not particularly limited. The crosslinking agent is generally 10 to 100 mass %, preferably 20 to 80 mass %, and more preferably 30 to 60 mass % based on the total base resin solids content.

Moreover, the second colored coating composition may optionally and suitably contain a solvent, such as water or an organic solvent; various additives for coating compositions, such as a rheology control agent, a pigment dispersant, an antisettling agent, a curing catalyst, an antifoaming agent, an antioxidizing agent, and an ultraviolet absorber; an extender pigment; and the like.

The second colored coating composition may be prepared by mixing and dispersing the components described above.

The second colored coating composition is applied by a method, such as electrostatic spraying, air spraying, or airless spraying. The second colored coating composition is generally applied such that the resulting coating film, when cured, has a thickness of 0.5 to 30 μm, and preferably 2 to 25 μm from the viewpoint of the smoothness, etc. of the coating film.

The second colored coating composition is preferably prepared in a manner such that the solids content is generally 15 to 50 mass %, and preferably 20 to 40 mass %, and the viscosity as measured using a B-type viscometer (Rotor No. 3 or 4) at 20° C. is 2000 to 6000 mPa·s.

The second colored coating film formed from the second colored coating composition has a light transmittance of 20 to 90%, and preferably 25 to 60% at a wavelength of 400 to 700 nm.

In the present specification, the light transmittance at a wavelength of 400 to 700 nm indicates the average of the light transmittance measured at each wavelength in the range of 400 to 700 nm.

The second colored coating film per se, which is obtained by applying the second colored coating composition, can generally be cured at about 50 to 180° C. in the case of the thermo-setting type, and can generally be cured at about an ordinary temperature to about 80° C. in the case of the normal temperature drying type or a forced drying type.

In the method according to the present invention, the clear coating composition can be applied after the second colored coating film, which is obtained by applying the second colored coating composition, is cured, or the clear coating composition can be applied on the uncured second colored coating film, without curing the second colored coating film.

Step (3)

According to the method of the present invention, a clear coating composition is applied to the second colored coating film obtained by applying the second colored coating composition in a manner as described above to form a clear coating film.

As the clear composition used in the method of the present invention, those known per se can be used without any limitation. Specifically, the clear coating composition is a liquid or powder clear coating composition that contains, as an essential component, a resin component comprising a base resin and a crosslinking agent, and optionally contains additives for coating compositions, or a solvent such as water or an organic solvent. The clear coating composition is capable of forming a colorless or colored transparent coating film.

Examples of the base resin include resins having a crosslinkable functional group (e.g., hydroxy, carboxy, silanol, and epoxy), such as acrylic resin, polyester resin, alkyd resin, fluorine resin, urethane resin, and silicon-containing resin. Examples of the crosslinking agent include compounds or resins having functional groups reactive with the functional groups of the above-listed base resins, such as melamine resin, urea resin, polyisocyanate compounds, blocked polyisocyanate compounds, epoxy compounds or resin, carboxy-containing compounds or resin, acid anhydride, and alkoxysilyl-containing compounds or resin.

The proportion of the base resin and the crosslinking agent in the resin component is not particularly limited. The crosslinking agent is generally within the range of 10 to 100 mass %, preferably 20 to 80 mass %, and more preferably 30 to 60 mass % based on the total base resin solids content.

The clear coating composition may optionally and suitably contain a solvent, such as water or an organic solvent, and additives for coating compositions, such as a curing catalyst, an antifoaming agent, a ultraviolet absorber, a rheology control agent, and an antisettling agent.

The clear coating composition may suitably contain a color pigment, insofar as the transparency of the coating film is not impaired. As the color pigment, those known per se that are used for inks or coating compositions can be used singly or in a combination of two or more. The amount of the color pigment to be added varies depending on the kind, etc., of the color pigment to be used. It is generally within the range of 30 mass % or less, preferably 0.05 to 20 mass %, and more preferably 0.1 to 10 mass % based on the total solids content of the resin component in the clear coating composition.

The clear coating composition may be prepared by mixing and dispersing the components described above.

The clear coating composition is applied by a method, such as electrostatic spraying, air spraying, or airless spraying. The clear coating composition is generally applied such that the resulting coating film, when cured, has a thickness of preferably 15 to 50 μm, and particularly preferably 25 to 40 μm.

When the clear coating composition is a liquid, the liquid clear coating composition is preferably adjusted in a manner such that the solids content is generally 30 to 60 mass %, and preferably 40 to 50 mass %, and the viscosity as measured by Ford Cup No. 4 at 20° C. is 18 to 25 sec. The clear coating film per se obtained by applying the clear coating composition can be cured by heating at a temperature of about 70 to about 150° C.

Substrate

The substrate to which the method of the present invention can be applied is not particularly limited. Examples of the substrate include parts comprising metals, such as iron, zinc, aluminum, and magnesium; parts comprising alloys comprising these metals; parts plated or vapor-deposited with these metals; parts comprising glass, plastic, and foamed bodies of various materials; and the like. In particular, steel materials composing an automobile body are suitable. A degreasing treatment, a surface treatment, or the like, may optionally be carried out on these parts.

The parts can be used as substrates after the formation of an undercoating film and/or an intermediate coating film thereon, which is generally preferable.

The undercoating film is used for masking the surface of parts, and imparting corrosion resistance or rust resistance to parts. The undercoating film is formed by applying and curing an undercoating composition. The undercoating composition is not particularly limited, and those known per se, such as electrodeposition coating compositions and solvent-based primers, can be used.

The intermediate coating film is used for a base coat for masking the surface of parts and base coats, such as an undercoating film, improving adhesion between the base coat and the topcoating film, imparting chipping resistance to the coating film, etc. The intermediate coating film can be formed by applying and curing the intermediate coating composition to the surface of the part and the surface of the base coat, such as an undercoating film. The intermediate coating composition is not particularly limited, and those known per se can be used. For example, an organic solvent-based or aqueous-based intermediate coating composition comprising a heat-curable resin composition, a color pigment, etc., can be preferably used.

In the method of the present invention, when a part on which an undercoating film and/or an intermediate coating film is formed is used as a substrate, the first colored coating composition in Step (1) can be applied after heat-curing the undercoating film and/or intermediate coating film. In some cases, however, the first colored coating composition can be applied when the undercoating film and/or the intermediate coating film is uncured.

Formation of Multilayer Coating Film

According to the method of the present invention, a multilayer coating film can be formed by the following Steps (1) to (3):

(1) applying a first colored coating composition comprising an organic red pigment to form a first colored coating film having a hue such that the hue angle h in the L*C*h color space diagram is within the range of 23±3°, (2) applying a second colored coating composition comprising an organic red pigment to the first colored coating film to form a second colored coating film having a hue such that the hue angle h in the L*C*h color space diagram is within the range of 35±5°, and (3) applying a clear coating composition to the second colored coating film to form a clear coating film.

By setting the color difference ΔE between the first colored coating film and the multilayer coating film obtained by Steps (1) to (3) within the range of 20 to 30, a red-based multilayer coating film with high chroma and an excellent sense of depth and weatherability can be formed.

Further, by setting the range of the hue angle h of the first colored coating film and the second colored coating film to 23±3° and to 35±5°, respectively, the hue range of the first colored coating film is determined to be blue against the second colored coating film, and the hue range of the second colored coating film is determined to be yellow against the first colored coating film. Since the first colored coating film and the (transparent) second colored coating film each having the above hue range are laminated, an advantageous (preferable) effect for forming a red-based multilayer coating film having high chroma and an excellent sense of depth and weatherability can be obtained.

The thus-formed multilayer coating film preferably has a color difference such that the color difference (ΔE) in the L*a*b* color space between the multilayer coating film and the first colored coating film obtained by applying the first colored coating composition is within the range of 20 to 30, particularly preferably 20 to 27, and even more preferably 20 to 25.

The multilayer coating film to be formed preferably has a hue difference such that the hue angle h difference (Δh) in the L*C*h color space between the multilayer coating film and the first colored coating film obtained by applying the first colored coating composition is 5 to 20, particularly preferably 2 to 15, and even more preferably 3 to 10.

The "color value E," "chroma C*", and "hue angle h" can be determined as follows. The first colored coating film, which is obtained by applying the first colored coating composition to the coating plate on which the dark gray (N−2) coating film is previously formed, and then curing the film; or the multilayer coating film, which is obtained by applying the first colored coating composition, the second colored coating composition, and the clear coating composition obtained in Steps (1) to (3) to the coating plate on which the dark gray (N−2) coating film is previously formed, and then curing the films, is subjected to colorimetry using a multiangle spectrophotometer ("MA-68," trade name, produced by X-Lite Incorporated).

The difference Δh (h (multilayer)−h (1BC)) between the hue angle h (1BC) of the first colored coating film obtained by applying the first colored coating composition and the hue angle h (multilayer) of the multilayer coating film obtained by applying the first colored coating composition, the second colored coating composition, and the clear coating composition obtained in Steps (1) to (3), and curing the films is preferably+1 to 30, more preferably+2 to 25, and even more preferably+4 to 20.

The hue angle h can be measured using a multiangle spectrophotometer ("MA-68," trade name, produced by X-Lite Incorporated).

The color difference (ΔE) and the hue angle difference (Δh) between the first colored coating film and the multilayer coating film obtained in Steps (1) to (3), and the hue angle h of the first colored coating film and the second colored coating film can be easily adjusted by adjusting (performing a small-scale experiment) the types and amounts of pigments incorporated in the first colored coating composition, second colored coating composition, and clear coating composition used for forming the multilayer coating film.

Thus, the method for forming a multilayer coating film of the present invention is applicable to various industrial products, in particular, an automobile exterior panel.

Hereinbelow, the present invention is described in more detail with reference to Examples and Comparative Examples. However, the present invention is not limited to these Examples. The "parts" and "%" used herein are expressed on a mass basis, and the film thickness is based on the cured coating film.

EXAMPLES

Examples 1 to 5 and Comparative Examples 1 to 5

[i] Preparation of Substrate

A cationic electrodeposition coating composition "Elecron GT-10" (trade name, produced by Kansai Paint Co., Ltd., an epoxy resin polyamine-based cationic resin containing a blocked polyisocyanate compound as a curing agent) was applied by electrodeposition to a degreased and zinc-phosphate treated steel plate (JISG3141, size 400×300×0.8 mm) so that the resulting film, when cured, had a thickness of 20 μm, and then heated at 170° C. for 20 minutes to be cured by crosslinking, thereby forming an electrodeposition coating film.

An intermediate coating composition "LUGA BAKE Intermediate Gray" (trade name, produced by Kansai Paint Co., Ltd., a polyester resin/melamine resin base, an organic solvent type) was applied to the surface of the electrodeposition coating film of the obtained steel plate by air spray coating to a film thickness of 30 μm when cured. The resulting film was heated at 140° C. for 30 minutes to be cured by crosslinking. The thus-obtained dark gray (N−2) intermediate coating plate comprising an intermediate coating film was regarded as a substrate.

[ii] Production of Coating Composition

Production of Base Resin

Production Example 1

128 parts of deionized water and 2 parts of "Adekaria Soap SR-1025" (trade name, produced by ADEKA; emulsifier, active ingredient: 25%) were placed into a reaction vessel equipped with a thermometer, a thermostat, a stirring device, a reflux condenser, a nitrogen introducing pipe, and a dropping funnel. The mixture was stirred and mixed in a nitrogen flow, and heated to 80° C.

Subsequently, 1% of the entire amount of monomer emulsion for the core portion, which is described below, and 5.3 parts of a 6% ammonium persulfate aqueous solution were introduced into the reaction vessel, and maintained therein at 80° C. for 15 minutes. Thereafter, the remaining monomer emulsion for the core portion was added dropwise over a period of 3 hours to the reaction vessel maintained at the same temperature. After completion of the dropwise addition, the mixture was aged for 1 hour. Subsequently, the below-described monomer emulsion for the shell portion was added dropwise over a period of 1 hour, followed by aging for 1 hour. Thereafter, the mixture was cooled to 30° C. while gradually adding 40 parts of a 5% 2-(dimethylamino)ethanol aqueous solution thereto, and filtered through a 100-mesh nylon cloth, thereby obtaining an acrylic resin emulsion (a) having a mean particle diameter of 100 nm and a solids content of 30%. The obtained acrylic resin emulsion had an acid value of 33 mg KOH/g, and a hydroxy value of 25 mg KOH/g.

A monomer emulsion for the core portion: 40 parts of deionized water, 2.8 parts of "Adekaria Soap SR-1025", 2.1 parts of methylene bisacrylamide, 2.8 parts of styrene, 16.1 parts of methyl methacrylate, 28 parts of ethyl acrylate, and 21 parts of n-butyl acrylate were mixed and stirred, thereby obtaining a monomer emulsion for the core portion.

A monomer emulsion for the shell portion: 17 parts of deionized water, 1.2 parts of "Adekaria Soap SR-1025", 0.03 parts of ammonium persulfate, 3 parts of styrene, 5.1 parts of 2-hydroxyethyl acrylate, 5.1 parts of methacrylic acid, 6 parts of methyl methacrylate, 1.8 parts of ethyl acrylate, and 9 parts of n-butyl acrylate were mixed and stirred, thereby obtaining a monomer emulsion for the shell portion.

Production Example 2

35 parts of propylene glycol monopropyl ether was placed into a reaction vessel equipped with a thermometer, a thermostat, a stirring device, a reflux condenser, a nitrogen introducing pipe, and a dropping funnel, and heated to 85° C. Subsequently, a mixture comprising 30 parts of methyl methacrylate, 20 parts of 2-ethylhexyl acrylate, 29 parts of n-butyl acrylate, 15 parts of 2-hydroxyethyl acrylate, 6 parts of acrylic acid, 15 parts of propylene glycol monopropyl ether, and 2.3 parts of 2,2'-azobis(2,4-dimethylvaleronitrile) was added dropwise thereto over a period of 4 hours. After completion of the dropwise addition, the mixture was aged for 1 hour. Subsequently, a mixture of 10 parts of propylene glycol monopropyl ether and 1 part of 2,2'-azobis(2,4-dimethylvaleronitrile) was further added dropwise thereto over a period of 1 hour. After completion of the dropwise addition, the mixture was aged for 1 hour. 7.4 parts of diethanolamine was further added thereto, thereby obtaining a hydroxy-containing acrylic resin solution (b) having a solids content of 55%. The obtained hydroxy-containing acrylic resin had an acid value of 47 mg KOH/g, and a hydroxy value of 72 mg KOH/g.

Production Example 3

109 parts of trimethylolpropane, 141 parts of 1,6-hexanediol, 126 parts of 1,2-cyclohexanedicarboxylic acid anhydride, and 120 parts of adipic acid were placed into a reaction vessel equipped with a thermometer, a thermostat, a stirring device, a reflux condenser, and a water separator. The mixture was heated to a range of 160 to 230° C. over a period of 3 hours, followed by a condensation reaction at 230° C. for 4 hours. Subsequently, to introduce a carboxy group to the obtained condensation reaction product, 38.3 parts of trimellitic anhydride was added to the product, followed by a reaction at 170° C. for 30 minutes. Thereafter, the product was diluted with 2-ethyl-1-hexanol, thereby obtaining a hydroxy-containing polyester resin solution (c) having a solids content of 70%. The obtained hydroxy-containing polyester resin had an acid value of 46 mg KOH/g, a hydroxy value of 150 mg KOH/g, and a number average molecular weight of 1,400.

Production of First Colored Coating Composition and Second Colored Coating Composition Production Examples 4 to 7 and 8 to 14

For the first colored coating composition, a luster pigment and a color pigment containing an organic red pigment, and for the second colored coating composition, a color pigment containing an organic red pigment were respectively added in the amounts shown in Table 1 to 50 parts (solids content: 15 parts) of the acrylic resin emulsion (a) obtained in Production Example 1, 45.5 parts (solids content: 25 parts) of the acrylic resin solution (b) obtained in Production Example 2, 42.8 parts (solids content: 30 parts) of the polyester resin solution (c) obtained in Production Example 3, and 37.5 parts (solids content: 30 parts) of the melamine resin (trade name "Cymel 325" produced by Nihon Cytec Industries Inc., solids content: 80%), followed by stirring and mixing. Further, a polyacrylic acid thickener (trade name "Primal ASE-60" produced by Rohm & Haas Co., Ltd.,), 2-(dimethylamino)ethanol, and deionized water were added thereto, thereby obtaining first colored coating compositions Nos. 1 to 4 and second colored coating compositions Nos. 1 to 7 each having a pH of 8.0, a coating composition solids content of 25%, and a viscosity of 40 seconds as measured by Ford cup No. 4 at 20° C.

Pigments shown in Table 1 are detailed below.

Color Pigment

RUBINE TR (Note 1): diketo pyrrolo-pyrrole-based red pigment, trade name "DPP RUBINE TR" produced by BASF.

RT355D (Note 2): quinacridone red pigment, trade name "MAGENTA B RT-355-D" produced by BASF.

KNO (Note 3): iron oxide pigment, trade name "TODA COLOR KN-O" produced by Toda Kogyo Corp.

R6438 (Note 4): perylene red pigment, trade name "MAROON 179 229-6438" produced by Sun Chemical Co., Ltd.

R5000 (Note 5): carbon black pigment, trade name "RAVEN 5000 ULTRA III BEADS" produced by Columbian Carbon Co., Ltd.

TOR (Note 6): iron oxide pigment, trade name "SICOTRANS RED L2817" produced by BASF.

G314 (Note 7): phthalocyanine-blue pigment, trade name "chlorinated copper cyanine blue-G-314" produced by Sanyo Color Works Ltd.

Scale-like Luster Pigment

L2800 (Note 8): aluminum flake pigment covered with iron oxide, trade name "PALIOCROM ORANGE L2800" produced by BASF.

MH8801 (Note 9): Aluminum flake pigment, trade name "Aluminum P MH-8801" produced by Asahikasei Metals Co., Ltd.

MH8805 (Note 10): Aluminum flake pigment, trade name "Aluminum P MH-8805" produced by Asahikasei Metals Co., Ltd.

Hue Angle h

The hue angle h in the L*C*h color space of each of the first colored coating film obtained by the application of the first colored coating composition, second colored coating film obtained by the application of the second colored coating composition, and multilayer coating film obtained by sequentially applying the first colored coating composition, second colored coating composition, and clear coating composition according to Steps (1) to (3) was measured using a multiangle spectrophotometer ("MA-68," trade name, produced by X-Lite Incorporated).

Chroma C*

The chroma C* in the L*C*h color space of each of the first colored coating film obtained by the application of the first colored coating composition and multilayer coating film obtained by sequentially applying the first colored coating composition, second colored coating composition, and clear coating composition according to Steps (1) to (3) was measured using a multiangle spectrophotometer ("MA-68," trade name, produced by X-Lite Incorporated).

Table 1 shows the hue angle h, chroma C*, calculated Δh, and color difference (ΔE) in the L*a*b* color space between the first colored coating film and the multilayer coating film obtained by sequentially applying the first colored coating composition, second colored coating composition, and clear coating composition according to Steps (1) to (3). Table 1 also shows the light transmittance of the second colored coating film.

[iii] Preparation of Test Plate

A test plate was made by sequentially applying the first colored coating composition, second colored coating composition, and clear coating composition produced in [ii] above according to the following procedure.

Examples 1 to 6 and Comparative Examples 1 to 5

(Application of First Colored Coating Composition)

Any one of the first colored coating compositions Nos. 1 to 4 produced in [ii] above was applied to the intermediate coating plate produced in [i] above using a minibell rotary electrostatic coater at a booth temperature of 20° C. and a humidity of 75% so that the resulting film, when cured, had a thickness of about 10 μm.

(Application of Second Colored Coating Composition)

After the application of the first colored coating composition, the plate was allowed to stand at room temperature for 2 minutes. Subsequently, any one of the second colored coating compositions Nos. 1 to 7 produced in [ii] was applied to the uncured first colored coating film using a minibell rotary electrostatic coater at a booth temperature of 20° C. and a humidity of 75% so that the resulting film, when cured, had a thickness of about 7 μm.

(Application of Clear Coating Composition)

After the application of the second colored coating composition, the plate was allowed to stand at room temperature for 5 minutes and pre-heated at 80° C. for 3 minutes. Subsequently, a clear coating composition ("LUGA BAKE Clear" produced by Kansai Paint Co., Ltd., "trade name," acryl resin/amino resin base, organic solvent type) was applied to the uncured second colored coating film using a minibell rotary electrostatic coater at a booth temperature of 20° C. and a humidity of 75% so that the resulting film, when cured, had a thickness of about 35 μm.

In Example 6, as the clear coating composition, a color clear coating composition containing 0.7% of R6438 (Note 4) and 0.1% of TOR (Note 6) based on the total resin solids content was used.

After the plate was allowed to stand at room temperature for 15 minutes, the plate was heated at 140° C. for 30 minutes in a hot-air circulating oven to dry and cure the multilayer coating film comprising the first colored coating film, second colored coating film, and clear coating film at the same time, thereby producing a test plate.

Evaluation Test

The weatherability of each test plate obtained in the Examples and Comparative Examples was additionally evaluated. The test conditions are detailed below.

Evaluation of Weatherability

An accelerated weather resistance test was performed using a Super Xenon Weather-O-Meter (produced by Suga Test Instruments Co., Ltd.) defined in JIS B 7754. 2-hour xenon arc lamp irradiation combining 1 hour and 42 minutes of lamp irradiation and 18 minutes of rain was regarded as one cycle, and the test was repeated 500 times. After the test, the test plate was compared with a substitute coating plate which had been stored in an experimental room, and evaluated. The evaluation criteria are as follows. Table 1 shows the results.

(Discoloration)

A: No discoloration was observed in the coating film.

B: Discoloration was observed in the coating film.

(Fading)

A: No fading was observed in the coating film.

B: Fading was observed in the coating film.

The Examples and Comparative Examples shown in Table 1 clearly indicate that the multilayer coating films of the Examples had excellent chroma and weatherability; however, the multilayer coating films of the Comparative Examples had either poor chroma or poor weatherability.

INDUSTRIAL APPLICABILITY

The method for forming a multilayer coating film of the present invention is applicable to various industrial products, in particular, an automobile exterior panel.

The invention claimed is:

1. A method for forming a multilayer coating film, comprising the steps of:

(1) applying a first colored coating composition comprising an organic red pigment to form a first colored coating film having a hue such that hue angle h in an L*C*h color space diagram is within the range of 23±3°, (2) applying a second colored coating composition comprising an organic red pigment to the first colored coating film to form a second colored coating film having a hue such that hue angle h in an L*C*h color space diagram is within the range of 35±5°, and (3) applying a clear coating composition to the second colored coating film to form a clear coating film;

wherein a color difference ΔE between the first colored coating film and the multilayer coating film obtained by Steps (1) to (3) is within the range of 20 to 30.

2. The method for forming a multilayer coating film according to claim 1, wherein as the organic red pigment, the first colored coating composition comprises a quinacridone pigment and the second colored coating composition comprises a perylene pigment.

TABLE 1

| | Example | | | | | | Comparative Example | | | | |
|---|---|---|---|---|---|---|---|---|---|---|---|
| | 1 | 2 | 3 | 4 | 5 | 6 | 1 | 2 | 3 | 4 | 5 |
| First colored coating film h | 23 | 26 | 20 | 23 | 23 | 23 | 23 | 32 | 23 | 32 | 32 |
| First colored coating film $C^2$ | 30 | 26 | 35 | 30 | 30 | 30 | 30 | 24 | 30 | 24 | 24 |
| Second colored coating film h | 35 | 35 | 35 | 35 | 35 | 35 | 33 | 35 | 18 | 18 | 35 |
| Multilayer coating film h | 32 | 32 | 32 | 34 | 31 | 32 | 32 | 31 | 28 | 28 | 26 |
| Multilayer coating film $C^2$ | 37 | 34 | 40 | 35 | 37 | 37 | 38 | 33 | 37 | 37 | 31 |
| Color difference ΔE | 23 | 28 | 26 | 20 | 30 | 23 | 31 | 18 | 17 | 28 | 25 |
| Color difference Δh (h(multilayer) − h(1BC)) | 9 | 6 | 12 | 11 | 8 | 9 | 9 | −1 | 5 | −4 | −6 |
| Light transmittance | 55 | 55 | 55 | 55 | 55 | 55 | 45 | 55 | 55 | 55 | 55 |
| Water resistance (discoloration) | A | A | A | A | A | A | A | A | B | B | A |
| Water resistance (fading) | A | A | A | A | A | A | B | B | B | A | A |
| First colored coating composition No. (pigment composition) | 1 | 2 | 3 | 1 | 1 | 1 | 1 | 4 | 1 | 4 | 4 |
| RUBINE TR (Note 1) | 6 | 5 | 8 | 6 | 6 | 6 | 6 | | 6 | | |
| RT355D (Note 2) | 2 | 1 | 3 | 2 | 2 | 2 | 2 | | 2 | | |
| KNO (Note 3) | 1 | 1 | 1 | 1 | 1 | 1 | 1 | 1 | 1 | 1 | 1 |
| R6438 (Note 4) | | | | | | | | 8 | | 8 | 8 |
| R5000 (Note 5) | 0.5 | 0.5 | 0.5 | 0.5 | 0.5 | 0.5 | 0.5 | 0.5 | 0.5 | 0.5 | 0.5 |
| I2800 (Note 6) | 5 | 5 | 5 | 5 | 5 | 5 | 5 | | 5 | | |
| MH8801 (Note 9) | 8 | 8 | 8 | 8 | 8 | 8 | 8 | | 8 | | |
| MH8805 (Note 10) | | | | | | | | | | | |
| Second colored coating composition No. (pigment composition) | 1 | 1 | 1 | 2 | 3 | 7 | 4 | 1 | 5 | 5 | 6 |
| R6438 (Note 4) | 3.5 | 3.5 | 3.5 | 2.5 | 4.5 | | 4 | 3.5 | | | 3.5 |
| TOR (Note 6) | 0.5 | 0.5 | 0.5 | 0.5 | 0.5 | | | 0.5 | 0.5 | 0.5 | |
| RT355D (Note 2) | | | | | | | | | 3.5 | 3.5 | |
| G314 (Note 7) | | | | | | | | | | | 0.5 |
| RUBINE TR (Note 1) | | | | | | 6 | | | | | |
| RT355D (Note 2) | | | | | | 2 | | | | | |
| KNO (Note 3) | | | | | | 1 | | | | | |
| R6438 (Note 4) | | | | | | | | | | | |
| R5000 (Note 5) | | | | | | 0.5 | | | | | |
| L2800 (Note 8) | | | | | | 5 | | | | | |
| MH8801 (Note 9) | | | | | | 8 | | | | | |

3. The method for forming a multilayer coating film according to claim 1, wherein the first colored coating composition and the second colored coating composition each comprise an iron oxide pigment.

4. The method for forming a multilayer coating film according to claim 1, wherein the first colored coating composition comprises an aluminum pigment covered with iron oxide.

5. The method for forming a multilayer coating film according to claim 2, wherein the first colored coating composition and the second colored coating composition each comprise an iron oxide pigment.

6. The method for forming a multilayer coating film according to claim 2, wherein the first colored coating composition comprises an aluminum pigment covered with iron oxide.

7. The method for forming a multilayer coating film according to claim 3, wherein the first colored coating composition comprises an aluminum pigment covered with iron oxide.

8. The method for forming a multilayer coating film according to claim 5, wherein the first colored coating composition comprises an aluminum pigment covered with iron oxide.

* * * * *